United States Patent [19]

Rhodes

[11] 4,082,679

[45] Apr. 4, 1978

[54] LIGHT STABILIZED TEXTILE MINERAL OIL

[75] Inventor: Rufus K. Rhodes, New York, N.Y.

[73] Assignee: Witco Chemical Corporation, New York, N.Y.

[21] Appl. No.: 776,158

[22] Filed: Mar. 10, 1977

[51] Int. Cl.[2] ..... D06M 13/34

[52] U.S. Cl. ..... 252/8.8; 8/115.6; 428/378

[58] Field of Search ..... 252/8.8 R; 8/115.6; 260/308 A; 428/378

[56] References Cited

U.S. PATENT DOCUMENTS

| | | | |
|---|---|---|---|
| 2,093,863 | 9/1937 | Clarkson | 252/8.6 |
| 3,004,896 | 10/1961 | Heller et al. | 424/60 |
| 3,189,615 | 6/1965 | Heller et al. | 260/308 |
| 3,642,813 | 2/1972 | Kirchmayr et al. | 260/308 |
| 3,686,202 | 8/1972 | Kirchmayr et al. | 260/308 |
| 3,769,294 | 10/1973 | Catino et al. | 260/308 |
| 3,880,875 | 4/1975 | Strobel et al. | 260/308 |

*Primary Examiner*—William E. Schulz
*Attorney, Agent, or Firm*—Albert L. Gazzola; Morton Friedman

[57] ABSTRACT

A textile oil is disclosed which comprises a technical white mineral oil and approximately 150 parts per million of a 2-aryl-4,5-arlyo-1,2,3,-triazole, particularly a substituted compound thereof such as 2-(3′,5′-di-tertbutyl-2′-hydroxy-phenyl)-5-chlorobenzotriazole. The aforesaid oil when exposed to ultra-violet light for an extended period does not discolor and when employed to lubricate a textile fiber will not impart discoloration to the textile fiber after exposure to ultraviolet light for extended periods.

18 Claims, No Drawings

LIGHT STABILIZED TEXTILE MINERAL OIL

This invention relates to improvements in textile oils and more particularly to providing a light-stabilized textile grade mineral oil for lubricating textile fibers.

It is well known in the art to treat oils with a U.V. stabilizer to protect the oil against discoloration. By the present invention, this U.V. stabilized oil when applied as a lubricant to textile fibers surprisingly imparts to the lubricated fibers protection against discoloration from the presence of the residual oil lubricant.

Heretofore, only fully refined or medicinal grade mineral oils, in contradistinction to technical white mineral oils, were color stable in the presence of ultra-violet light. That is, the fully refined mineral oil was one in which undesirable aromatics and unsaturates were removed, whereas in the technical grade mineral oil certain residuals of aromatics and unsaturates were present thereby causing color deterioration with ultra-violet exposure.

In the lubrication of textile fibers, a technical grade or textile grade mineral oil is used for economy purposes. After lubrication, a residue of this mineral oil remains on the fibers and after exposure to U.V. light, these fibers tend to discolor. The use of a medicinal grade white oil, more costly than the technical grade, results in less discoloration of the fibers when exposed to U.V. light, but even this lesser discoloration, although more acceptable, does not resolve the problem of discoloration of the fibers after lubrication. When using the present technical grade white oil treated with a small amount of 2-aryl-4,5-arlyo-1,2,3-triazole, surprisingly, the lubricated fibers remain color fast after exposure to U.V. light over prolonged periods.

Clarkson et al, U.S. Pat. No. 2,093,863, granted Sept. 21, 1937, discloses the use of mineral oil as an ingredient in textile oil. Presently textile oils comprise substantial moieties of a technical white mineral oil. Such mineral oil moieties are often 90 percent by weight. The textile grade mineral oil is customarily applied to the textile fibers prior to the knitting or weaving operation to protect the fibers from the weaving action of the knitting or weaving machines. Often the fibers, after treatment with the oil, are stored for prolonged periods of hundreds, if not thousands of hours. During this storage period, the fibers are unavoidably subject to ultra-violet rays. As a result of such exposure the mineral oil would discolor, thereby imparting an undesirable and commercially unacceptable appearance to the textile fibers.

Heller et al. I, U.S. Pat. No. 3,004,896, granted October 17, 1961 and Heller II, U.S. Pat. No. 3,189,615, granted June 15, 1965, disclose certain 2-aryl-4,5-arylo-1,2,3-triazoles. Heller I, discloses the incorporation of 2-aryl-4,5-arylo-1,2,3-triazole compounds within polymers for protection against ultra-violet rays.

Kirchmayr et al I, U.S. Pat. No. 3,642,813 granted Feb. 15, 1972, and Kirchmayr et al II, U.S. Pat. No. 3,686,202, granted Aug. 22, 1972, disclose certain triazole compounds which when incorporated within or drawn into polymeric materials, protect the materials.

Catino, U.S. Pat. No. 3,769,294, granted Oct. 30, 1973, discloses certain naphthotriazoles which when incorporated within various transparent plastic sheets absorb ultra-violet light and protect light-reactive material underneath the sheet.

Strobel, U.S. Pat. No. 3,880,875, granted Apr. 29, 1975, discloses -1,2,3, triazole derivatives as UV absorbents for various polymers and for skin protection preparations. Incidental quantities of mineral oil are often present in skin preparations. It is also known in the prior art that many UV-containing skin preparations when exposed to UV light, absorb the UV rays and in so doing discolor, but protect the skin in doing so.

It is an object of this invention to provide a light stabilized textile mineral oil.

It is another object of the present invention to provide a textile oil as aforesaid wherein a substantial fraction of a technical white mineral oil is present.

It is another object of the present invention to provide a lubricant coated textile fiber wherein the coating is a light stabilized mineral oil so as to prevent the imparting of discoloration to the fiber upon long exposure to ultra-violet light.

It is still another object of the invention to provide a coated fiber as aforesaid wherein the fiber is a synthetic fiber.

Therefore, there has now been found a textile grade oil comprising high weight percentages of a technical white mineral oil, which textile oil protects the substrate textile fiber to which it is applied by absorbing UV rays and also does not itself discolor under the influence of UV exposure, thereby maintaining the commercially acceptable appearance of the fiber.

Broadly speaking, in one aspect the composition of the present invention comprises a light stabilized mineral oil comprising a technical white mineral oil and from 50 to about 250 ppm of a 2-aryl -4,5 arylo-1,2,3-triazole. And in a preferred aspect the technical white mineral oil is present in about 90 to 95 percent by weight, the remainder being the various additives as known in the art.

In another aspect, the present invention comprises a textile fiber having a lubricating, UV protective coating thereon, wherein the coating is the aforesaid oil of the present invention.

The term "medicinal grade mineral oil" or "fully refined mineral oil", as used hereinbefore and hereinafter refers to a mineral oil from which substantially all residues of aromatics and unsaturates have been removed as defined in Section 121.1146 of 31 Federal Register 3394.

The term "technical white mineral oil", as used hereinbefore and hereinafter shall be as defined in 31 Federal Register 3394, amend. Mar. 4, 1966, Seciton 121.2589(b).

The term "finished oil" or "finished mineral oil", as used hereinbefore and hereinafter shall mean a white mineral oil (50 to 100 SUS at 100° F) usually of a technical white mineral oil caliber, containing an emulsifier (e.g., ethoxylated alcohol or phenol), and usually an anti-static agent. The finished oil is employed in fiber or spin finish applications as well as in fiber knitting. Finished oil contains at least about 50 percent by weight of the technical white mineral oil, and often 80 to 90 percent, and preferably in many cases above 90 percent to about 95 percent, the remainder being additives such as the aforesaid as well as others known in the art.

Suitable triazole compounds pursuant this invention have the formula:

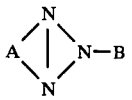

In this formula the triazole ring is written in the conventional manner but the arrangement or valences at the nitrogen atom is left undetermined. In this formula:

A represents a phenylene radical bound by two adjacent carbon atoms to two nitrogen atoms of the triazole ring, and B represents a phenyl radical, substituted by groups not imparting strong coloration.

B may be a phenyl radical having a free hydroxyl group in the 2-position with regard to the linkage with the triazole ring and which can be further substituted in other positions as defined, in particular by lower alkyl, lower alkoxy, lower cyclohexyl, phenyl groups and hologen. Compounds containing such substituents in the 5-position are advantageous.

Particularly valuable sub-classes of compounds of the present invention (actively UV-absorbing compounds) are compounds having a free hydroxyl group in the 2-position with regard to the linkage with the triazole ring and which are substituted in the 3- and 5- or in the 4- and 5-positions by lower alkyl and chlorine.

In particular compounds which contain a lower alkoxy or acyloxy or a lower alkyl group in the 2-position with regard to the linkage with the triazole ring or which contain hydrogen, chlorine or lower alkyl in the 5-position or an OH group in the 4-position, both with regard to the linkage to the triazole ring, are of particular interest.

Halogens such as, e.g. fluorine, chlorine, bromine; alkyl groups such as methyl, ethyl, butyl, amyl, octyl, dodecyl groups; substituted alkyl groups such as the tri-fluoromethyl group; alicyclic groups such as the cyclo-hexyl group, methyl cyclohexyl groups or such as the polymethylene groups, e.g. the a.$\beta$-tetramethylene group; aralkyl groups such as the benzyl group, alkyl or alkoxy or halogen benzyl groups; aryl groups such as phenyl or alkoxyphenyl groups; R—O groups wherein R represents hydrogen, an alkyl radical, aralkyl radical such as benzyl, an aryl radical such as phenyl, chlorophenyl or alkylphenyl radical; carbacyl groups such as an alkyl carbonyl, arylcarbonyl or alkoxycarbonyl radical, R—CO-groups wherein R represents hydrogen, an alkyl radical, an aralkyl radical such as benzyl, an aryl radical such as phenyl or chlorophenyl radical; a hydroxyl group, an alkoxy or an aryloxy group, and amino radical, an organically substituted amino radical, e.g. a monoalkyl, monocycloalkyl, monoaralkyl or monophenylamino group, a dialkylamino group, dicycloalkylamino group, diaralkylamino group, alkylaralkylamino group or alkyl-phenylamino group; R-$SO_2$ groups in which R represents a hydroxyl group, an alkyl radical, aralkyl radical such as benzyl, aryl radical such as phenyl, alkyl phenyl or alkoxy phenyl radical, an amino group such as $H_2N$—, an organically substituted amino group such as, e.g. a monoalkyl, monocycloalkyl, monoaralkyl, mono-phenyl, dialkylamino group, diaralkyl amino groups such as dibenzyl amino group, dicycloalkyl amino groups such as dicyclohexylamino group, alkylaralkyl amino groups such as alkylbenzyl amino groups and an alkylaryl amino group such as alkylphenyl amino groups, can be used as substituents of the aromatic rings, in particular of the radicals A and B.

All these groups are bound to the rings A and B by carbon, oxygen or sulphur atoms. If aromatic radicals are substituents or are in substituents, they can be substituted as A or B. Aromatic radicals should be bound to A or B either direct as in diphenyl derivatives or by means of saturated divalent bridging members not having dyeing characteristics. Examples of such briding members are saturated hydrocarbon radicals, oxygen or sulphur either atoms, carbonyl, sulphoxide, sulphonyl, disulphimide, carboxyl-sulphimide groups.

The most preferred substituted -1, 2, 3 benzotriazole is 2-(3',5'-di-tert-butyl-2'-hydroxylphenyl)-5-chlorobenzotriazole having the structure:

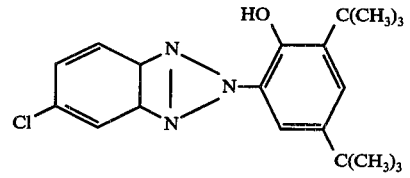

The compounds according to the present invention are produced by coupling aryldiazonium compounds with azo components of the benzene and naphthalene series coupling in the o-position to a primary amino group, which azo components may also be further substituted as defined, and oxidizing the o-aminoazo dyestuffs thus formed to the corresponding 1,2,3,-triazole compound. They can also be produced by coupling o-nitro aryl diazonium compounds of the benzene or naphthalene series with phenols or naphthols coupling in the o- or p-positions or with amines of the benzene and naphthalene series coupling in the p-positions to a primary amino group, and then reducing the o-nitro-azo dyestuffs by the usual methods, e.g. with ammonium sulphide or with zinc in an alkaline medium to form the 1,2,3,-triazole compounds. In these processes also the aromatic rings can be further substituted as defined. In the end product free hydroxyl groups can also be alkylated or acylated. Primary amino groups must be removed by diazotizing them and replacing the diazo group, by the usual methods, by for example, hydrogen, halogen or cyano or hydroxyl groups.

The invention is now illustrated by examples of certain representative embodiments thereof, wherein all parts, proportions, and percentages are by weight unless otherwise indicated.

EXAMPLE I

A first sample was prepared by mixing a technical white mineral oil in accordance with CFR 121.2589b with 150 parts per million (ppm) of Tinuvin 327 (Tinuvin, is a registered trademark of Ciba-Beigy Corp., Ardsley, N.Y.), and is a 2-(3',5' -ditert-butyl-2' hydroxyphenyl)-5 chlorobenzotriazole.

A second sample, as a control, consisted of the technical white mineral oil as in the first sample but without the addition of the Tinuvin 327.

Both oil samples had an original color of +30 as measured on the Saybolt scale (ASTM D-156). On exposure to a UV source (GE lamp UA-3) for a period of 50 hours, the first sample retained the +30 color value whereas the second sample deteriorated to a color value of 15.

When the aforesaid first and second samples are applied to white textile threads, and the threads exposed to UV source for 50 hours, the thread being coated with the first oil sample does not deteriorate in color appearance whereas the thread coated with the second oil sample shows color deterioration.

EXAMPLE II

A third sample was prepared by mixing a finished textile oil comprising white mineral oil (CFR 121.2589b), emulsifier, and anti-static agent, with 150 parts per million (ppm) of Tinuvin 327 (Tinuvin, is a registered trademark of Ciba-Geigy Corp., Ardsley, N.Y.), and is a 2- (3',5' -di-tert-butyl-2' hydroxy phenyl)-5 chlorobenzotriazole.

A fourth sample, as a control, consisted of the finished textile oil as in the third sample but without the addition of the Tinuvin 327.

Both oil samples had an original color of +30 as measured on the Saybolt scale (ASTM D-156). On exposure to a UV source (GE lamp UA-3) for a period of 72 hours, the third sample retained the +30 color value whereas the fourth sample deteriorated to a color value of 16–20.

When the aforesaid third and fourth samples are applied to white textile threads, and the threads exposed to UV source for 72 hours; the thread being coated with the third oil sample does not deteriorate in color appearance whereas the thread coated with the fourth oil sample shows color deterioration.

Suitable textile fibers which may be coated pursuant to present invention include the natural fibers (e.g., cotton, wool, worsted, and the like) and the synthetic fibers (e.g., polyesters, nylon, polypropylene, and the like). The coating of the present invention is particularly suited to synthetic textile fibers in spin finishing and coning applications.

In spin finishing, the oil coating is immediately applied after extrusion of the synthetic fiber for the purpose of providing lubrication to the fiber as it passes through guides and to give body to the fiber on the cone to prevent the fiber from falling off the cone. The oil coating of the present invention may also be employed in texturizing wherein the yarn is twisted in a heated chamber, and wherein the oil is applied immediately after texturizing by roller coating. In another preferred application, the oil is applied during knitting by directly coating the knitting needles with the oil.

The aforesaid oils and oil coatings of the present invention may be prepared employing conventional mixing techniques and appropriate additional ingredients may be added for specifically desired end product applications.

Although only specific compositions and applications of the present invention have been described and illustrated, numerous changes could be made without departing from the spirit of the invention, and all such changes that fall within the scope of the appended claims are intended to be embraced thereby.

What is claimed is:

1. A light stabilized mineral oil comprising, a technical white mineral oil and from 50 to about 250 ppm of a 2-aryl -4,5 arylo-1,2,3-triazole.

2. The oil of claim 1, wherein the white mineral oil is present in about at least 50 to about 95 percent by weight.

3. The oil of claim 2, wherein the triazole is present in about 150 ppm.

4. The oil of claim 2, wherein the triazole is 2-(3',5'-di-tert-butyl-2'-hydroxyphenyl)-5 chlorobenzotriazole.

5. The oil of claim 4, further comprising an emulsifier.

6. The oil of claim 5, further comprising an antistatic agent.

7. A light stabilized coated fiber comprising a textile fiber having a coating therein comprising a technical white mineral oil and from 50 to about 250 ppm of a 2-aryl -4,5 arylo-1,2,3-triazole.

8. The coated fiber of claim 7, wherein the fiber is a synthetic fiber.

9. The coated fiber of claim 8, wherein the fiber is a polyester.

10. The coated fiber of claim 7, wherein the white mineral oil is present in about at least 50 to about 95 percent by weight.

11. The coated fiber of claim 10, wherein the triazole is present in about 150 ppm.

12. The coated fiber of claim 10, wherein the triazole is 2-(3',5'-di-tert-butyl-2'-hydroxyphenyl)-5 chlorobenzotriazole.

13. The coated fiber of claim 12, further comprising an emulsifier.

14. The coated fiber of claim 13, further comprising an anti-static agent.

15. The coated fiber of claim 7, wherein the technical white mineral oil is present is from about 90 to 95 percent by weight, the remainder being additives.

16. A light stabilized mineral oil comprising from 50 to about 98 percent by weight of a technical white mineral and a triazole compound having the following formula:

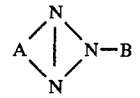

wherein;

N is nitrogen;

A is phenylene bounded by two adjacent carbon atoms bonded in turn to the two respective nitrogen atoms; and B is phenyl substituted in at least one position by one selected from the group, alkyl, alkoxy, cyclohexyl, phenyl and halogen.

17. The oil of claim 16, wherein B is substituted in the 2-position with respect to the triazole likage, by hydroxyl.

18. The oil of claim 17, wherein said substituted group of B is in the 5-position.

* * * * *